US007204756B2

(12) United States Patent
Jubinville et al.

(10) Patent No.: US 7,204,756 B2
(45) Date of Patent: Apr. 17, 2007

(54) LOTTERY SYSTEM WITH METHOD FOR PAYING MULTIPLE PROGRESSIVE JACKPOTS

(75) Inventors: Chantal Jubinville, Wayne, NJ (US); Arthur S. Robb, Hackensack, NJ (US); Alan Kyle Bozeman, Rutherford, NJ (US)

(73) Assignee: Scientific Games Royalty Corporation, Newark, DE (US)

( * ) Notice: Subject to any disclaimer, the term of this patent is extended or adjusted under 35 U.S.C. 154(b) by 315 days.

(21) Appl. No.: 10/668,458

(22) Filed: Sep. 23, 2003

(65) Prior Publication Data

US 2005/0064930 A1 Mar. 24, 2005

(51) Int. Cl.
*A63F 3/06* (2006.01)

(52) U.S. Cl. ..... 463/17; 463/25

(58) Field of Classification Search ..... 463/17, 463/18, 25, 26, 27, 28; 273/269
See application file for complete search history.

(56) References Cited

U.S. PATENT DOCUMENTS 4,842,278 A * 6/1989 Markowicz ..... 463/18
5,564,700 A 10/1996 Celona
5,885,158 A 3/1999 Torango et al.
6,004,207 A 12/1999 Wilson, Jr. et al.

(Continued)

FOREIGN PATENT DOCUMENTS

WO WO 95/12181 * 5/1995

(Continued)

*Primary Examiner*—Xuan M. Thai
*Assistant Examiner*—Matthew D. Hoel
(74) *Attorney, Agent, or Firm*—Carlton Fields, PA; Lance D. Reich

(57) ABSTRACT

In one aspect, the invention is directed to a method for awarding at least a portion of a jackpot amount in a lottery game for a plurality of players. The method may include accepting an entry from each of the plurality of players for an occurrence of the lottery game, wherein each entry may include a first subset of numbers selected from a predetermined range of numbers, and determining an outcome for the occurrence of the lottery game, wherein the outcome for the occurrence of the lottery game may include a second subset of numbers selected from the predetermined range of numbers. The method may also include comparing the first subset of numbers for each of the entries to the second subset of numbers for the outcome of the lottery game, and determining the number of matched numbers for each entry between the first subset of numbers for the entry and the second subset of numbers. Still further, the method may include determining that none of the entries for the occurrence of the lottery game match every number in the first subset of numbers for the entry to a corresponding one of the numbers in the second subset of numbers, and awarding a share of the at least a portion of the jackpot amount to at least a portion of the entries for the occurrence of the lottery game wherein none of the numbers of the first subset of numbers of the entry match any of the numbers in the second subset of numbers for the outcome of the lottery game.

5 Claims, 7 Drawing Sheets

U.S. PATENT DOCUMENTS

| | | | | |
|---|---|---|---|---|
| 6,210,275 | B1 | 4/2001 | Olsen | |
| 6,210,276 | B1 * | 4/2001 | Mullins | 463/27 |
| 2002/0037766 | A1 * | 3/2002 | Muniz | 463/17 |
| 2003/0013516 | A1 * | 1/2003 | Walker et al. | 463/25 |
| 2004/0152504 | A1 * | 8/2004 | Herrmann et al. | 463/16 |
| 2004/0152505 | A1 * | 8/2004 | Herrmann et al. | 463/16 |
| 2004/0152510 | A1 * | 8/2004 | Herrmann et al. | 463/25 |
| 2004/0229676 | A1 * | 11/2004 | Duhamel et al. | 463/16 |
| 2005/0035547 | A1 * | 2/2005 | Henry | 273/274 |
| 2006/0178197 | A1 * | 8/2006 | Kane et al. | 463/18 |
| 2006/0214376 | A1 * | 9/2006 | Weller | 273/292 |
| 2006/0252488 | A1 * | 11/2006 | Lalonde et al. | 463/17 |

FOREIGN PATENT DOCUMENTS

| | | | |
|---|---|---|---|
| WO | WO 01/74460 | A2 * | 10/2001 |

* cited by examiner

LOTTERY SYSTEM WITH METHOD FOR PAYING MULTIPLE PROGRESSIVE JACKPOTS

BACKGROUND

This invention relates to lottery systems for conducting lottery games and, more particularly, to lottery systems incorporating methods for paying out large progressive and non-progressive jackpot awards.

Various lottery systems incorporating methods for paying out jackpots for large progressive and non-progressive jackpots to lottery players have been previously described. For example, U.S. Pat. No. 6,017,032 to Grippo discloses a lottery game including two or more different denominational levels for game tickets, i.e., two or more groups of tickets with tickets in each group being priced differently from tickets in the other group. All tickets in any one group are priced identically to one another. Wagers received from each ticket group are placed in a corresponding jackpot pool according to the denominational level or amount of the tickets sold for that pool. All wagers for each denomination are processed by a single controlling authority, with wagers being distributed to each separate pool according to the corresponding wager denomination. Thus, the game provides a series of different and separate jackpot pools corresponding to each ticket price or denominational level. Jackpots or prizes are awarded from each pool to the winning bettor holding a ticket corresponding to that denominational level and jackpot. Alternatively, the pools may be combined and divided in accordance with the total amount of each wager denominational level group. The game may run for a predetermined amount period of time, or to a predetermined date, or through the sales of a predetermined number of tickets in a given denominational group or groups, as desired. Prizes (e.g., automobiles, etc.) may be awarded in addition to money, at the higher or highest denominational levels. A percentage of each pool, or of the combined total, may be retained by the operating authorities for overhead, charitable or government use, etc., if so desired.

U.S. Pat. No. 5,540,441 to Ilan discloses a pyramid game randomly that assigns integers to players of the game, and arranges the player positions corresponding to those integers in a pyramidal hierarchy having a geometric progression of the powers of two, from a single number at the apex to multiple numbers in a base row. Provision is made for redistribution of player positions forming only a fraction of a row, proportionately to other rows to ensure that the base row or level contains no more than half of the total player positions. The integers of the player positions are arranged in numerical order, with the highest number at the apex and other numbers distributed to the remaining player positions in descending order. Alternatively, an apex number may be randomly selected, with the remaining lower numbers positioned in descending order therebelow and any higher numbers positioned following the lower numbers. Numbers corresponding to the lowermost row or level in the pyramidal hierarchy receive no payoff, with numbers in higher levels receiving increasing amounts; all positions in a given level receive equal amounts. Thus, a player knowing the high and low limiting numbers of the game and who randomly receives a number in the set, will quickly have at least some idea of a possible payoff according to the relative position of his/her number in the set. The lottery game is adaptable to large numbers of players in a lottery system, and may be played electronically and/or using printed lottery tickets or the like.

SUMMARY OF THE INVENTION

In one aspect, the invention is directed to a method for awarding at least a portion of a jackpot amount in a lottery game for a plurality of players. The method may include accepting an entry from each of the plurality of players for an occurrence of the lottery game, wherein each entry may include a first subset of numbers selected from a predetermined range of numbers, and determining an outcome for the occurrence of the lottery game, wherein the outcome for the occurrence of the lottery game may include a second subset of numbers selected from the predetermined range of numbers. The method may also include comparing the first subset of numbers for each of the entries to the second subset of numbers for the outcome of the lottery game, and determining the number of matched numbers for each entry between the first subset of numbers for the entry and the second subset of numbers for the outcome of the lottery game based on the comparison of the first subset of numbers for each entry to the second subset of number for the outcome of the lottery game. Still further, the method may include determining that none of the entries for the occurrence of the lottery game match every number in the first subset of numbers for the entry to a corresponding one of the numbers in the second subset of numbers for the outcome of the lottery game, and awarding a share of the at least a portion of the jackpot amount to at least a portion of the entries for the occurrence of the lottery game wherein none of the numbers of the first subset of numbers of the entry match any of the numbers in the second subset of numbers for the outcome of the lottery game.

In another aspect, the invention is directed to a method for a warding at least a portion of a jackpot amount in a lottery game for a plurality of players that may include accepting an entry from each of the plurality of players for an occurrence of the lottery game, wherein each entry may include a first subset of numbers selected from a predetermined range of numbers. The method may include determining an outcome for the occurrence of the lottery game, wherein the outcome for the occurrence of the lottery game may include a second subset of numbers selected from the predetermined range of numbers, and comparing the first subset of numbers for each of the entries to the second subset of numbers for the outcome of the lottery game. The method may further include determining the number of matched numbers for each entry between the first subset of numbers for the entry and the second subset of numbers for the outcome of the lottery game based on the comparison of the first subset of numbers for each entry to the second subset of number for the outcome of the lottery game, and determining that none of the entries for the occurrence of the lottery game match every number in the first subset of numbers for the entry to a corresponding one of the numbers in the second subset of numbers for the outcome of the lottery game. Still further, the method may include randomly selecting a number from the range of zero to one less than the maximum number of numbers in the first subset of numbers, and awarding a share of the at least a portion of the jackpot amount to each entry having the same number of numbers from the corresponding first set of numbers matching numbers from the second subset of numbers for the occurrence of the lottery game as the randomly selected number from the range of zero to one less than the maximum number of numbers in the first subset of numbers.

In a further aspect, the invention is directed to a method for awarding at least a portion of a jackpot amount in a lottery game for a plurality of players. The method may include dividing the jackpot amount into a base jackpot amount and a bonus jackpot amount, accepting an entry from each of the plurality of players for an occurrence of the lottery game, wherein each entry may include a first subset of numbers selected from a predetermined range of numbers, and determining an outcome for the occurrence of the lottery game, wherein the outcome for the occurrence of the lottery game may include a second subset of numbers selected from the predetermined range of numbers. The method may also include comparing the first subset of numbers for each of the entries to the second subset of numbers for the outcome of the lottery game, determining the number of matched numbers for each entry between the first subset of numbers for the entry and the second subset of numbers for the outcome of the lottery game based on the comparison of the first subset of numbers for each entry to the second subset of number for the outcome of the lottery game, and determining that at least one of the entries for the occurrence of the lottery game matched every number in the first subset of numbers for the entry to a corresponding one of the numbers in the second subset of numbers for the outcome of the lottery game. Still further, the method may include randomly selecting a percentage from the range of zero percent to one hundred percent, awarding a share of the base jackpot amount to each entry matching every number in the first subset of numbers for the entry to a corresponding one of the numbers in the second subset of numbers for the outcome of the lottery game, determining a bonus jackpot payout amount by multiplying the bonus jackpot amount by the randomly selected percentage, and awarding a share of the bonus jackpot payout amount to each entry matching every number in the first subset of numbers for the entry to a corresponding one of the numbers in the second subset of numbers for the outcome of the lottery game.

In a still further aspect, the invention is directed to a method for awarding at least a portion of a jackpot amount in a lottery game for a plurality of players. The method may include dividing the jackpot amount into a plurality of partial jackpot amounts, accepting an entry from each of the plurality of players for an occurrence of the lottery game, and determining an outcome for the occurrence of the lottery game. The method may further include comparing each of the entries to the outcome of the lottery game, determining whether each entry is a winning entry for the occurrence of the lottery game based on the comparison of the entry to the outcome of the lottery game, and determining that at least one of the entries is a winning entry of an award of at least a portion of the jackpot amount. Still further, the method may include randomly selecting a first percentage from the range of zero percent to one hundred percent, awarding a share of a first one of the partial jackpot amounts to each winning entry of the award of at least a portion of the jackpot amount, determining a first bonus jackpot payout amount by multiplying a second one of the partial jackpot amounts by the randomly selected first percentage, and awarding a share of the first bonus jackpot payout amount to each entry winning entry of the award of at least a portion of the jackpot amount.

Additional aspects of the invention are defined by the claims of this patent.

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Lottery Network

Figure 1:
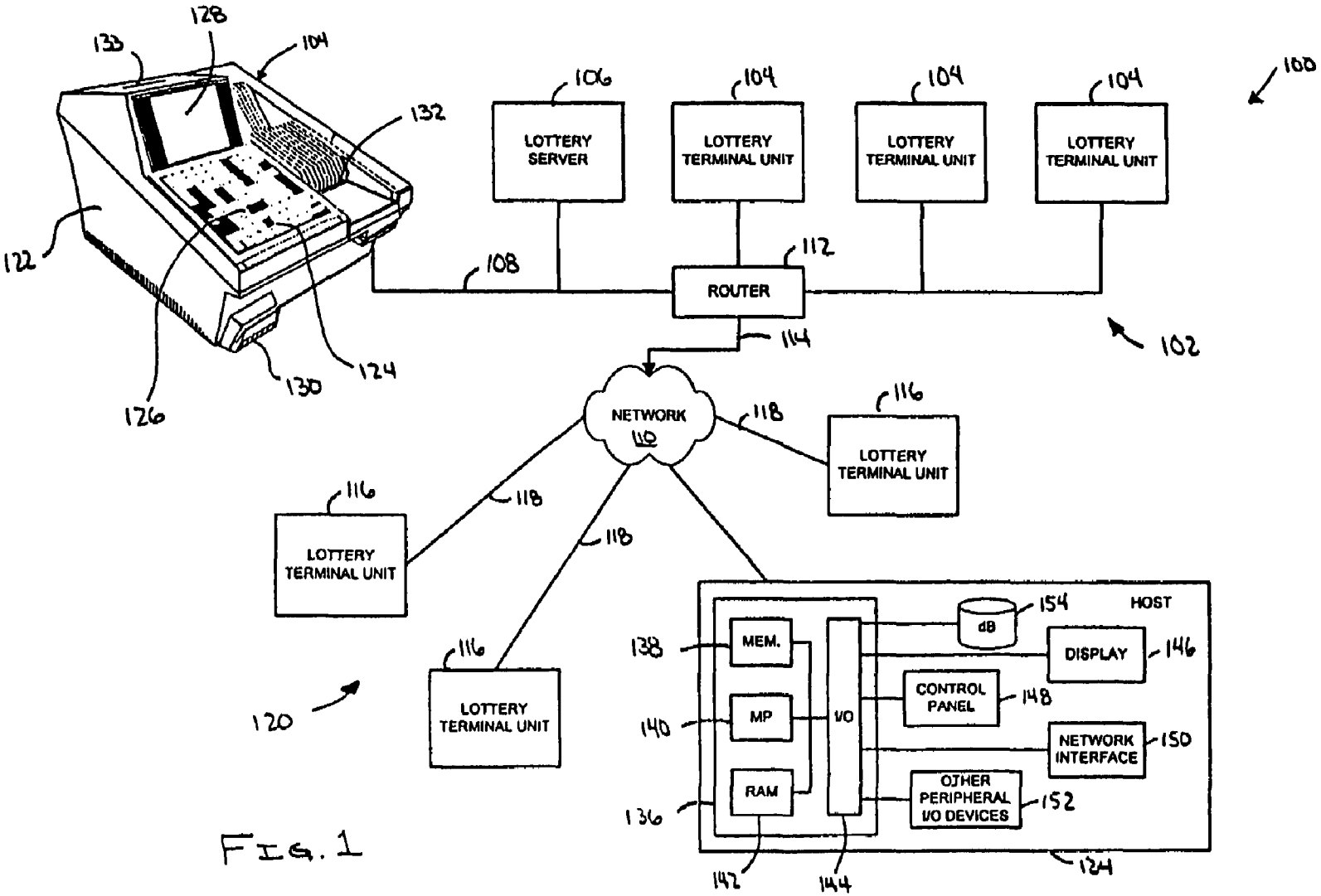
FIG. 1 is a block diagram of an embodiment of a networked lottery system.

FIG. 1 illustrates one possible embodiment of a lottery network 100 that may implement a multi-theme instant win game in conjunction with a lottery-type game. Referring to FIG. 1, the lottery network 100 may include a first group or network 102 of lottery terminal units 104 operatively coupled to a lottery network computer or server 106 via a network data link or bus 108. The lottery network 100 may be coupled to a network 110, which may be, for example, the Internet, a wide area network (WAN), or a local area network (LAN) through a network hub or router 112 via a first network link 114. In one possible configuration, the first network 102 may be a state lottery system operating within an individual state or region of states. In this configuration, the individual lottery terminal units 104 may be interconnected to a central system for tracking and coordination of the state lottery system, including issued tickets, drawn numbers, and/or amounts waged.

The lottery network 100 may further include other lottery terminal units 116 that may be directly connected to the network 110 through a plurality of direct network links 118, thereby eliminating the need for the bus 108, router 112 or other networking equipment. Each lottery terminal unit 116 in this configuration may represent a group of lottery retailers participating in the state lottery, as described above, or a plurality of the lottery terminal units 116 may be grouped together to form a lottery node 120. The lottery nodes 120, in turn, may be directly connected and/or multiplexed to the network 110 via the direct network links 118. Further, the direct network links 118 may represent secure communications channels physically hardened against tampering and/or the communications may be encrypted to prevent unauthorized access to information transmitted thereon.

FIG. 1 further illustrates a perspective view of one possible embodiment of a lottery terminal unit 104. Although the following description relates to the design of the lottery terminal unit 104 depicted in FIG. 1, it should be understood that the lottery terminal units 104 and 116 may include similar features or may be configured with functionality to allow the entry of the information required for a player to participate in a lottery game. The exemplary lottery terminal unit 104 may include a housing or casing 122, and one or more input and output devices, which may be, among other things, a control panel 124 having a plurality of input keys 126, a display 128, a value input device such as a card reader 130, a lottery play slip or ticket reader 132, and a lottery ticket printer 133. The lottery play slip reader 132 may be configured to read bar codes, user selections, magnetically stored information or any other desired input information or media used to encode information on a play slip or lottery ticket.

The input keys 126 may allow the player or sales agent to select the game to be played, input the value to be wagered, manually enter the selected lottery characters, and input any other information necessary to play a given lottery game. The display 128 may be a LCD, a CRT, a touch-screen capable of receiving and displaying information, or any other suitable device capable of displaying the information input via the input keys 126, the lottery play slip reader 132 or the touch-screen input. The value input device may include any device that can accept value or a wager from a customer, such as the card reader 130 or an optical currency collector. The value input device may further be integrated with external devices, such as cash registers or other retail terminals, communicatively connected to the lottery terminal unit 104, to exchange information necessary to receive and record the wagering transactions. The lottery ticket printer 133 may be used to print or otherwise encode lottery tickets with information selected or required to play a given lottery game. Further, the lottery ticket printer 133 may provide lottery tickets, or even completed lottery slips if the selections were generated automatically, that could be used by the player in other lottery terminal units 116 equipped with lottery play slip or ticker readers 132.

Moreover, the lottery terminal units 104, 116 and lottery nodes 120 may include centralized or shared display mechanisms such as a scrolling digital signs or messaged boards configured to display the outcome of a completed lottery game and advertises or attract players to upcoming games. In one exemplary configuration, at least one lottery terminal unit 104 or 116 includes software for generating graphics and is communicatively connected to an external LCD suitable for displaying graphics. Upon completion of a lottery drawing, the results or winning information can be formatted by the graphical software and displayed, in an eye-catching manner, on the external LCD. Alternatively, the graphical software may be stored on a peripheral device, such as a CD-ROM, and the result of the lottery drawing communicated thereto for formatting and display.

The network 110, and hence the individual lottery terminal units 104 and 116, may be communicatively connected to a central host computer 134. The central host computer 134 may be a single networked computer, or a series of interconnected computers having access to the network 110 via a gateway or other known networking system. Generally, the central host computer 134 may include a central lottery controller 136 configured to manage, execute and control the individual lottery elements 104, 116 and 120 and the routines used to play the various lottery games. The central lottery controller 136 may include a memory 138 for storing lottery programs and routines, a microprocessor 140 (MP) for executing the stored programs, a random access memory 142 (RAM) and an input/output bus 144 (I/O). The memory 138, microprocessor 140, RAM 142 and the I/O bus 144 may be multiplexed together via a common bus, as shown, or may each be directly connected via dedicated communications lines, depending on the needs of the lottery system 100.

Further, the central lottery controller 136 may be directly connected, hardwired, or indirectly connected through the I/O bus 144 to external components such as a display 146, a control panel 148, a network interface device 150 and other peripheral I/O devices 152. Examples of other peripherals device include, but are not limited to, storage devices, wireless adaptors, printers, and the like. In addition, a database 154 may be communicatively connected to the central lottery controller 136 and provide a data repository for the storage and correlation of information gathered from the individual lottery terminal units 104, 116 or lottery nodes 120. The information stored within the database 154 may be information relating to individual lottery terminal units 104, 116 such as terminal specific information like a terminal identification code, sales agent code, and location for each lottery ticket printed. The database 154 may further include ticket specific information such as the type of game played (Lotto, Pick-3, Pick-4 etc.), or game specific information such as the total lottery sales, drawing outcomes, amounts wagered, numbers selected by the players, and the like.

In operation, the central lottery controller 136 may operate as a clearing-house for the lottery terminal units 116 and the first lottery network 102, whereby the lottery network computer 106 collects, stores and analyzes status and operational information relating to each lottery terminal unit 104. For example, the lottery network computer 106 may continuously receive transactional data from the individual lottery terminal unit 104 indicative of the number of tickets sold and associated dollar amounts, and the lottery numbers and number order generated at each lottery terminal unit. The transactional data collected by the lottery network computer 106 may be communicated to the central host computer 134 continuously or may be processed into a batch format and transmitted periodically for storage in the database 154. If, for example, the central lottery controller 136 and the lottery network computer 106 are communicating continuously, it may be desirable for the central lottery controller 136 to execute the actual lottery routine and transmit the results to the lottery network computer 106 for distribution to the lottery terminal units 104 and directly to the lottery terminal units 116. In addition, it may be desirable for the central lottery controller 136 to include, via the peripheral device input 152, a scanner, such as the lottery play slip reader 132, for directly importing/reading manual selections into the database 154.

It will be understood that the lottery network 100 illustrated in FIG. 1 may alternatively represent the network layout within a gaming establishment providing a lottery-type game. In this alternate configuration, each stand-alone lottery terminal unit 104 may be an interactive player terminal capable of playing a variety of lottery or casino games, such as a lottery game, Keno, Bingo, video poker, video blackjack, slots, and the like. The lottery terminal units 104 may be distributed throughout a single gaming establishment or casino and connected with a LAN, or throughout multiple casino sites and connected with a WAN. Further, the LAN and/or WAN connecting each of the lottery terminal units 104 may include one or more separate and secure buses 108, routers 112, web servers, gateways and other networking equipment to provide continuous and/or redundant connectivity to the network 110. The network 110, configured in this manner, provides a system for players to collectively participate in a centralized lottery-type game. Further, the network 110 may include express gaming stations at which players may generate predefined or automatically selected lottery tickets simply by making a selection and a wager. As discussed above, the network 110 may be communicatively connected to the central host computer 134, the central lottery controller 136, and the database 142 to allow for implementation, storage, tracking and analysis of the lottery game.

The central host computer 134 may store the software for managing one or more lottery games offered in the lottery system 100. Some jurisdictions may limit the number of lottery games that may be offered by a lottery system. Consequently, once a lottery system offers the maximum number of lottery games allowed by the jurisdiction, it may be necessary to remove or otherwise decommission an existing lottery game in order to implement a new lottery game. Moreover, when a new game is implemented in the lottery system, it may be necessary to perform certification testing on the new lottery game to ensure compliance of the lottery game with the applicable gaming regulations. Therefore, it may be desirable to be able to reuse lottery game functionality in order to avoid certifying or recertifying lottery game software, and to conserve the limited number of available lottery game positions available in the lottery system.

Lottery Unit

Figure 2:
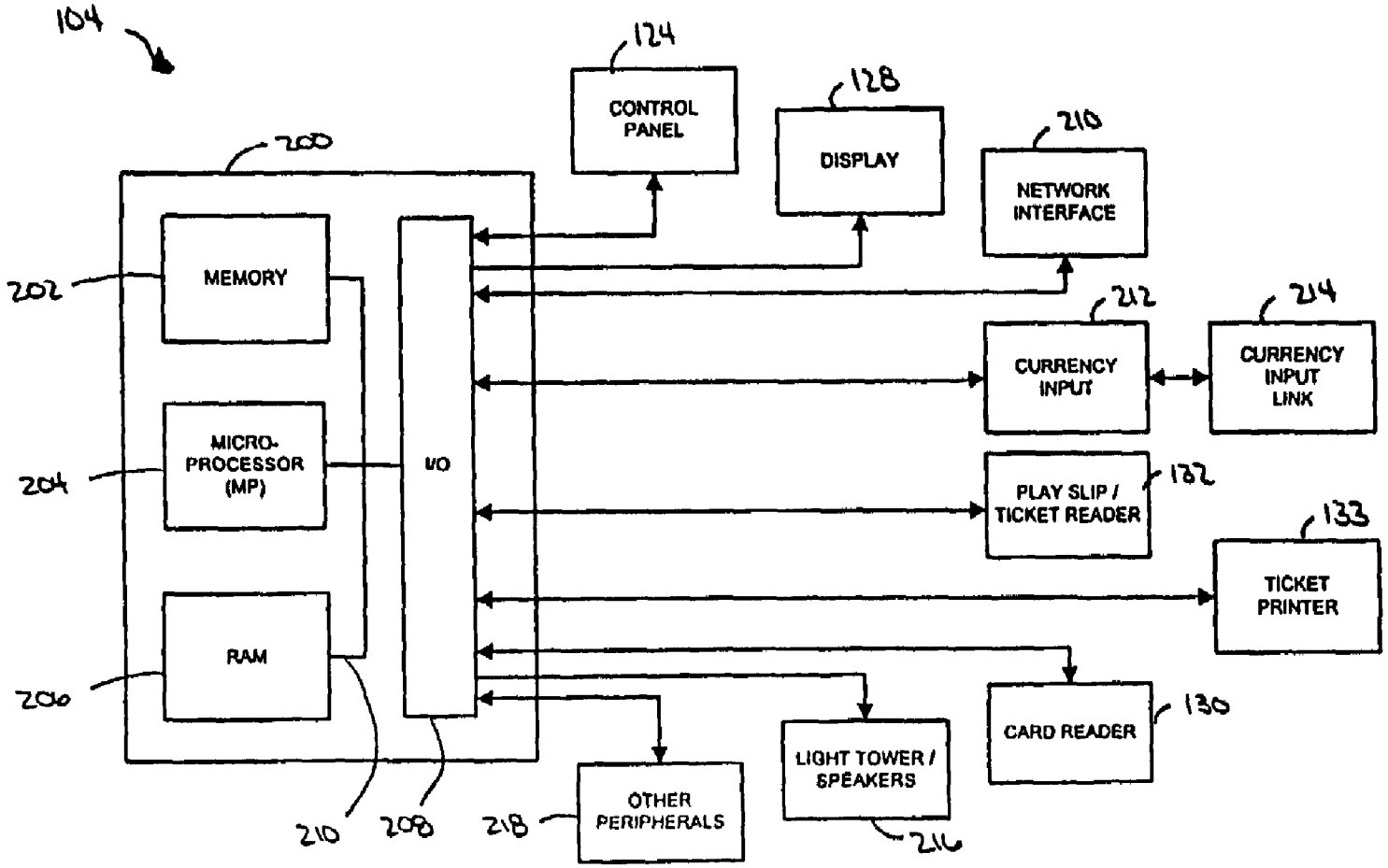
FIG. 2 is a block diagram of the electronic components of the lottery terminal unit shown in FIG. 1.

FIG. 2 illustrates a block diagram of an embodiment of the internal electronic components of the lottery terminal unit 104. The lottery terminal unit 116 may have the same or a different design, but may be configured to receive player entries into the lottery games and process winning lottery tickets. Referring to FIG. 2, the exemplary lottery terminal unit 104 may include a number of internal components such as a controller 200 having a program memory 202, a microcontroller or microprocessor (MP) 204, a random access memory (RAM) 206, and an input/output (I/O) bus 208, all of which may be interconnected via an address or data bus 210. It should be understood that while only one microprocessor 204 is shown herein, the controller 200 may be designed to support multiple microprocessors 204 arranged to operate in parallel or in any other known configuration. Similarly, the controller 200 may include multiple, and even redundant, program memories 202 and random access memories 206 to increase expandability, capacity and/or processing speed. The multiple processor and memory configurations may be used, for example, to isolate the individual lottery functions such as basic lottery operation, random number generation, information tracking, and the like. Although the I/O bus 208 is shown as a single addressable and integral block, it should be understood that direct I/O connections may be made, as well as any other desired I/O connection scheme. The program memory 202 and random access memory 206 may be implemented as a solid-state memory, an integrated circuit, a magnetically readable memory, and/or optically readable memories. Further, the program memory 202 may be read only memory (ROM) or may be read/write memory such as a hard disk. In the event that a hard disk is used as the program memory, the data bus 210 may comprise multiple address/data buses, which may be of differing types, and there may be a separate I/O circuit between the data buses.

FIG. 2 schematically illustrates that the controller 200 may be communicatively connected to the control panel 124, the display 128, the card reader 130, the lottery play slip or ticket reader 132 and the lottery ticket printer 133. The controller 200 may further be communicatively connected to a network interface card (NIC) or device 210, a currency input device 212 including a currency input link 214, and a light and speaker link 216. The network interface card 210 may be configured to allow the lottery terminal unit 104 to communicate information with other networked devices similarly connected to the network 110 using any known protocol or standard suitable for a lottery or network application. The currency input device 212 may be any kind of value input device discussed above, or may include a currency input link 214 communicatively connected to a cash register (not shown) or other device for tracking and/or totaling currency or transactions. The light and speaker link 214 may be used to integrate visual and/or audio displays into the design of the lottery terminal unit 104.

FIG. 2 illustrates the components 124, 128–132, and 210–218 directly connected the I/O bus 208 via dedicated circuits or conductors. However, it will be understood that different connections schemes may be used. For example, some of the components requiring limited communications with the controller 200 may be communicated via an auxiliary I/O bus (not shown) in a scheduled manner, while other components requiring fast communications or large data transfers may be directly connected to the I/O bus 208. Furthermore, depending on the needs of the system, some of the components may be directly connected to the microprocessor 184 without having to pass through the I/O bus 208.

Lottery Play Slips and Tickets

Regardless of the configuration or layout of the lottery system 100, it may often be the case that the lottery terminal unit 104, 116 will include lottery play slips or ticket readers 132 which may be used to scan an instant game ticket or a lottery play slip 300 (FIG. 3), which may, for example, be a play slip for a Keno game, completed by the player, and a lottery ticket 302 (FIG. 4), which may be, for example, a Keno game lottery ticket, previously generated at a lottery ticket printer 133, to determine whether the ticket contains a winning combination. The lottery play slip 300 and the lottery ticket 302 may be composed of paper, Mylar, cardboard or any other suitable printable or encodable material.

The lottery play slip 300 and ticket 302 may include informational, instructional or security information such as a bar code, award details, authentication numbers, or any other desired information. Further, it will be understood that different ticket types and formats may be used depending on the theme, format and rules of the game. The lottery ticket 302 may be printed with any optically readable material such as ink, or encoded with data on a magnetic material, smart chip or other media for encoding data.

Figure 3:
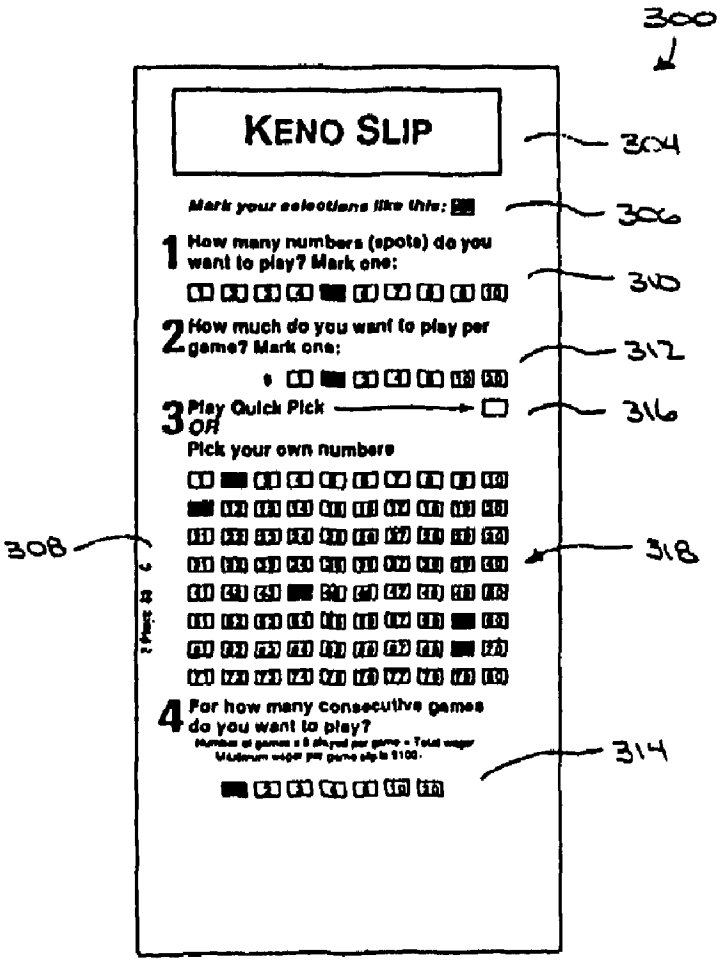
FIG. 3 illustrates an embodiment of a lottery play slip that may be read by the lottery terminal unit of FIG. 2.

Referring to FIG. 3, the lottery play slip 300 can be configured and arranged in any number of variations for use in lottery games such as Keno, Lotto, Powerball-style games, Pick-3 and Pick-4 games, and the like, but may typically include a number of common indicia or information. For example, the exemplary Keno play slip 300 may include a title 304 indicative of the associated game, a set of directions or instructions 306, and a plurality of game specific selections, as generally indicated by the numeral 308. The game specific selections may allow the player to define how many numbers or characters associated with the lottery game to play 310, the exact amount to be wagered 312, and the number of games or drawings to be entered 314. Further, the lottery play slip 300 may be arranged with indicia 316 to allow a player to play the lottery game with Quick Pick selections (i.e. selections automatically and randomly determined by one of the lottery terminal units 104, 116 or the central lottery controller 136), and/or with manual selection indicia 318 arranged to allow the player to select the player's entry from a predefined list of numbers, letters or characters associated with the lottery game. In this manner, the player or a sales agent can fill-out, code or otherwise record the information necessary to participate in a specific lottery game, and provide that information to a central collection point, such as the lottery terminal unit 104, 116 or the central host computer 136 for processing and/or recordation. The reverse side of the play slip 300 may also have indicia (not shown) thereon with information relating the lottery game, such as instructions on how to play the game, win and claim prizes, schedules or tables of prize amounts and odds of winning, requirements for playing or filling out play slips, lottery disclaimers, and the like.

The exemplary lottery play slip 300 illustrated in FIG. 3 is configured to allow the player to make entry in a Keno game. The player may select how many numbers or spots are to be matched in a given Keno game at 310, thereby decreasing the odds of winning and simultaneously increasing the potential payout of a winning selection. By selecting a Quick Pick at area 316, the player may allow the lottery terminal unit 104 to randomly select a plurality of numbers equal to the number of spots indicated at 310. However, the player may opt to manually select the numbers by choosing numbers, or spots, between 1 and 80, as indicated in the manual selection area 318. Finally, the manual or automatic selections may be consecutively played by indicating the desired number of games, for example one, two, three, four, five, ten or twenty, at area 314.

Figure 4:
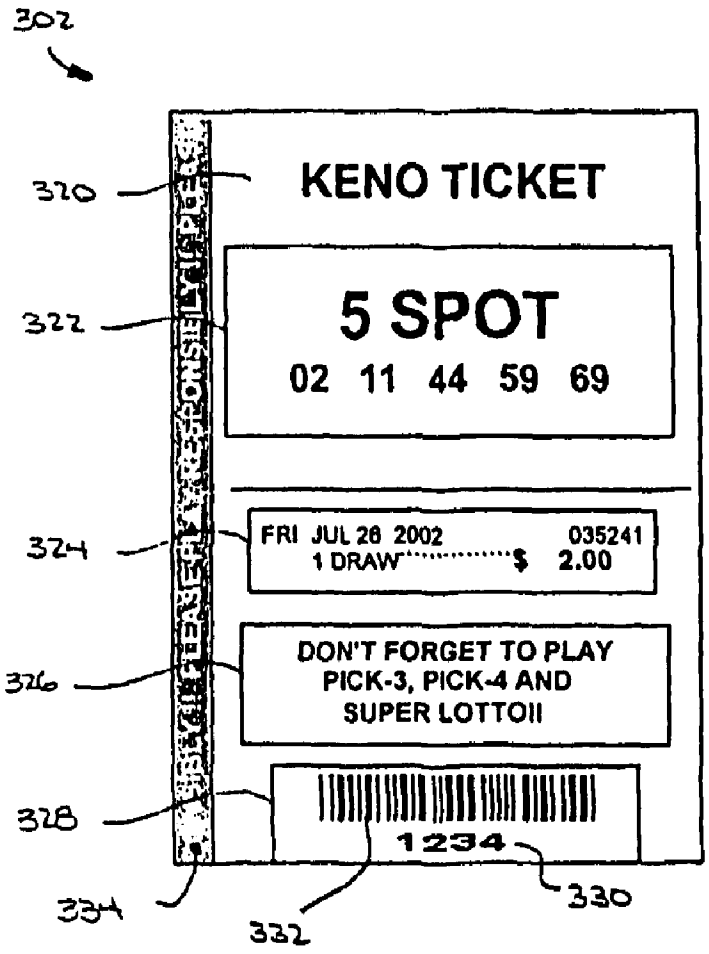
FIG. 4 illustrates an embodiment of a lottery ticket that may be generated by the lottery terminal unit of FIG. 2.

FIG. 4 illustrates the exemplary lottery ticket 302 that may be generated in response to the selections made by the player on the lottery slip 300. For example, the lottery ticket 302 may include a title 320 indicative of the game being played, a game area 322 that may provide results, confirmation information or other game-related information, and a status area 324 that may include wager information, drawing date, tracking information and the like. Further, the lottery ticket 302 may include an advertising area 326 where messages or other consumer information may be printed, and a coding area 328 that may have a tracking number 330 and a machine-readable code 332, such as a barcode, that may be read by the play slip/ticket reader 132 to retrieve information for the ticket. The tracking code 330 and graphical code 332 may be used to confirm the validity of the ticket, the location of purchase, amount of wager, numbers selected or any other desired information. The lottery ticket stock, or blank, may be preprinted with additional information such as, a public service message 334, a disclaimer, game rules or any other desired end-user license or contract information.

It will be understood that to play the exemplary Keno game described above, the player may manually fill-out the lottery play slip 300 using a pencil, pen or other input method, and the player slip 300 may be read by the lottery play slip reader 132 of the lottery terminal unit 116 to input the player's selections into the lottery system 100. Alternatively, the player may key-in the desired selections at the lottery terminal unit 104, or instruct a sales agent to key-in the desired selections. Once the player's selections are entered into the lottery system 100, the inputted data may then be used by the lottery terminal unit 104, the lottery server 106, and/or the central host computer 134 to generate the lottery ticket 302 with information corresponding to the player's selections. The ticket 302 may serve as the player's receipt, or the lottery terminal 104 unit may print an additional receipt for the player. At the same time, the information for the player selections may be stored in a database, such as in the memory of the lottery terminal unit 104 or server 106, in database 154 or memory 138 of central host computer 134, or other storage location for later use in ticket validation, auditing, compliance monitoring, and the like. At this point, the player may also pay for the wager and games being played.

Lottery Routine

In general, lotteries may be implemented as the networked games described above, or as an instant game. Networked lottery games, such as Lotto and Powerball-style games wherein players may enter a drawing at any one of a number of sales agent locations having lottery terminal units 104, 116, are typically communicatively connected through the network 110 to the central host computer 134, as described above. Lotto and Powerball-style games often offer multi-thousand or multimillion-dollar jackpots, in which five or six numbers are randomly drawn from a pool of twenty or more possible numbers, and the player(s) who has selected, or has had the system select, matching numbers is a winner. Network lotteries may further be implemented as a number game, in a "Pick-3" or "Pick 4" format, in which three or four numbers are drawn from the integers 0 through 9. Number games such as these, in contrast to typical Lotto or Powerball-style games, are often performed with replacements (e.g., the number 2 could be drawn twice) and may distinguish by order (e.g. 3-4-5 may be a different outcome than 5-4-3).

The instant or "scratch-off" lotteries may be implemented as an artfully decorated piece of cardboard or other material with game characters or indicia concealed by a covering material such as latex. In one embodiment, the player simply scratches off the covering material to reveal whether or not the ticket is a winner. An alternate embodiment requires the player to scratch off and reveal a subset of the indicia on the ticket, and the player may or may not win based on the revealed indicia. For example, the scratch-off ticket may include six covered indicia, and the player must uncover three matching indicia, such as three "$20 WIN" spots, in order to win the twenty-dollar prize on the ticket. If one or more selected indicia does not match the other indicia, the player loses the instant win game. It will be understood that the "scratch-off" game may be implement on a video terminal by presenting a variety of indicia hidden behind selectable images. A video scratch-off game would require a player to select an image in an attempt to match indicia hidden there under.

Figure 5:
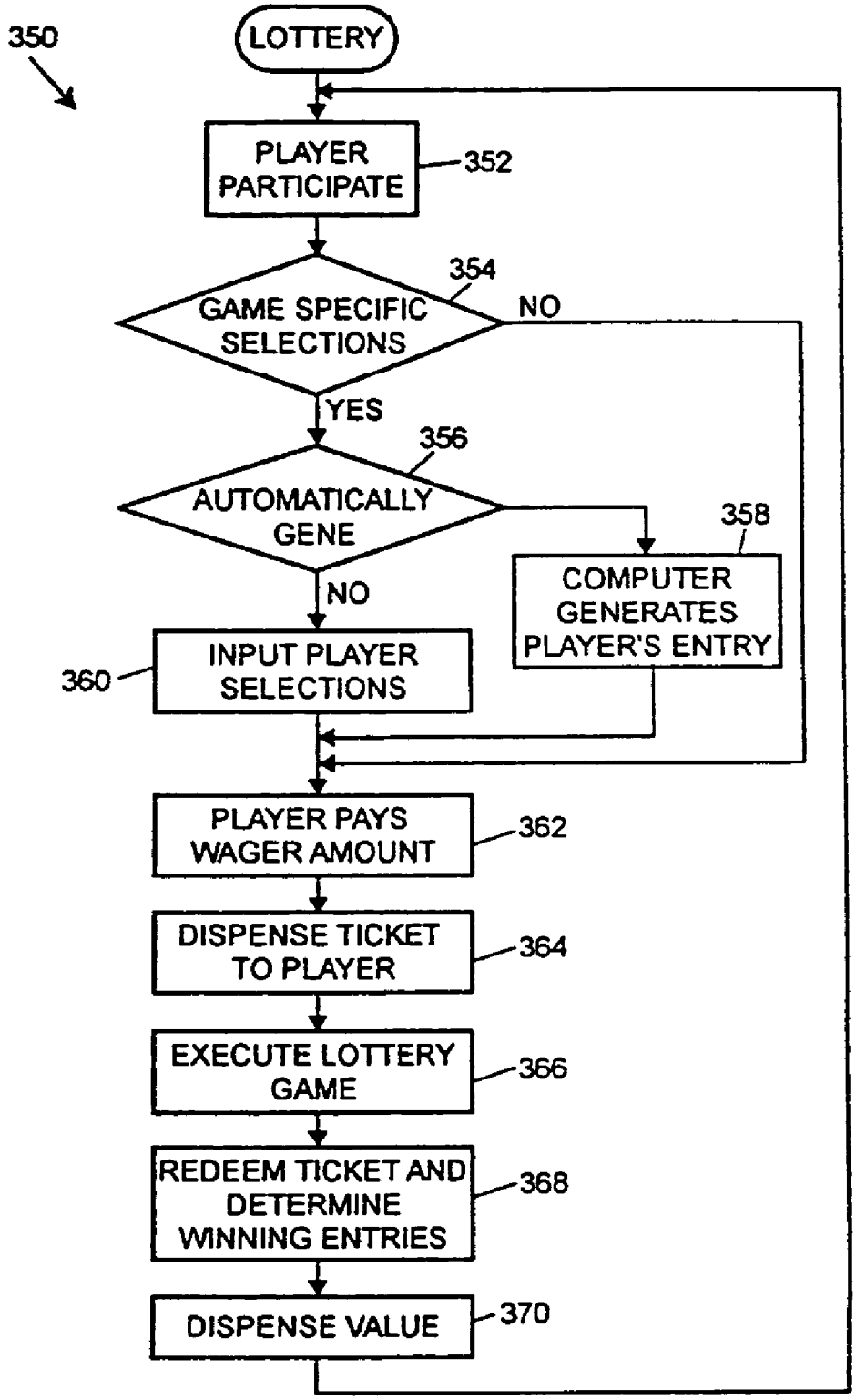
FIG. 5 is a flowchart of an embodiment of a lottery routine in which a player may participate.

FIG. 5 is a flowchart outlining a sample process flow of a lottery game 350 in which a player may participate. For the purpose of this example, and in order to describe various known lottery games, the routine is illustrated and described to implement and allow the player to participate in one of a plurality of lottery games. However, it will be understood by those skilled in the art that the routine may apply where any number of games is offered by the lottery system 100. Referring to FIG. 5, the manual lottery routine may begin at block 352 with a player deciding to participate in a lottery game. Based on the lottery game selected, the lottery game may require game-specific selections by the player when the player wagers or otherwise buys into the lottery game. If no game-specific selections are required at block 354, such as when purchasing an instant lottery and/or scratch-off ticket, the selection process is bypassed. If game-specific selections are required at block 354, a variety of game specific selections such as type of game to play, numbers or other game indicia to play in the game entry, the amount to wager, and number of times or drawings to play may be entered for the player. At block 356, the player may have the option to have the lottery system 100 automatically and randomly generate for the game characters or indicia to be played. If the player elects to automatically generate a ticket, control may pass to block 358 wherein one of the processors 140 or 204 may randomly generate a portion or all of the indicia for the player's entry. If the player elects to select characters or indicia to be used in the lottery game, either on a lottery play slip 300 or by input at the lottery terminal unit 104, they may do so at block 360.

Regardless of the manner in which the selections are made, upon completion of the selection process the player may pay the necessary wager amount at block 362 and the ticket may be dispensed as indicated at block 364. While shown and described as occurring in sequence with the player electing to participate, making game specific selections automatically or manually if necessary, paying the wager amount, and having a lottery ticket dispensed, the steps may occur in any order or concurrently as may be necessary or desired to implement a given lottery game or games. For example, the lottery terminal unit 104 may be configured to require a player to deposit money in a coin slot, currency reader, credit card reader or other value-deposit mechanism, before selecting a game and/or game-specific selections. Alternatively, sales agents may take all the information for the player's entry for the lottery game, print the corresponding lottery ticket and hand the ticket to the player before receiving the wager amount from the player. Those skilled in the art will understand that the steps of selecting a game, making game-specific selections, paying a wager amount and dispensing a lottery ticket may occur in any necessary sequence to accept player entries for the lottery games.

After the players' entries for the lottery game(s) are entered and the players have paid the necessary wager amounts, the lottery games may be executed at block 366. For lottery games involving a drawing, such as Lotto, Powerball-style games, Keno, Bingo, Pick-3 and Pick-4, the drawings may occur on a specified day and time, or at predetermined intervals, with the players being required to make their entries prior to the drawings. For other lottery games initiated by the players, such as instant win games and scratch-off games, the execution of the game occurs when the player performs the necessary actions with the lottery ticket to play the game. For each of these games, however, the execution of the lottery game involves a distinct process for determining the outcome of an occurrence of the game.

In a Lotto game, the players may wager on how many numbers they can match from a specified range of numbers or symbols. For example, during the game-specific selection, the players may select, or have the lottery system 100 select, six numbers from the range of whole numbers from, for example, 1 to 56. At the time of the drawing for the Lotto game, six numbers may be selected from the range of whole numbers from 1 to 56. The six numbers may be selected mechanically using a blower-type ball drawing machine containing a fifty-six balls, each having a number between 1 and 56 printed thereon, electronically using a random number generator or other random selection mechanism at, for example, the lottery host computer 134, or by any other mechanism for randomly selecting a subset of elements from a known set of elements. Winning player entries may be evaluated by comparing the players' selections to the drawing selections to determine the level of correspondence between the players' selections and the drawing selections. The greater the correspondence, the greater the prize may be, up to the awarding of a pregressive jackpot where a player's selections exactly match the drawing selections. If no player matches all six numbers in a Lotto drawing, the progressive jackpot may roll over to the next drawing, and the jackpot often may accumulate to tens of millions of dollars.

Powerball-style games may be similar to Lotto games, with players selecting a subset of a known range of numbers or symbols from multiple ranges of numbers or symbols. In one example of a Powerball-style game, players' entries consist of five numbers selected from the range of 1 to 53, and one additional number selected from the range of 1 to 42. When the drawing occurs, five numbers are selected from the range of 1 to 53, and one number is selected from the range of 1 to 42. As with Lotto games, the players' entries may also be evaluated by comparing the players' selections with the drawn selections, with prizes being awarded based on the level of correspondence up to a progressive jackpot for matching all five numbers and the additional number. Matching some or all of the five numbers from the range of 1 to 53 and not matching the one number from the range of 1 to 42, or matching the one number from the range 1 to 42 and none or up to four of the numbers from the range of 1 to 53 may result in winning a fixed prize amount, while matching all five numbers from the first range and the one number from the second range may result in winning a jackpot.

In contrast to progressive games such as Lotto and Powerball-style games, non-progress games, sometimes referred to a Cash Lotto may typically be held twice a week and entail the selection of five rather than six numbers from a predefined range of numbers. As with progressive games, the non-progressive game may be evaluated based on the level of correspondence between the numbers selected by the players and the numbers drawn from the predetermined range. Awards for the non-progressive games may be either based on a fixed pay table or funded by the players' wagers as a pari-mutuel pool. Consequently, non-progressive games do not have a jackpot that builds from game to game until it is won, and instead the jackpot may revert to the lottery sponsor if no player matches all five drawn numbers. The jackpot for a Cash Lotto is usually of the magnitude of one to several hundred thousand dollars. While the jackpots are relatively small, players may have a much better chance of winning the Cash lotto games than for the weekly progressive lotteries.

Keno games are well known for both lottery games and casino games. In typical Keno games, players select one to ten or one to fifteen numbers from the range of 1 to 80. At the time of the drawing, twenty numbers are selected from the range of numbers from 1 to 80. Players win based on the level of correspondence, or lack thereof, between the selected numbers and the drawn numbers, with the win amount for any player entry being determined based on the level of correspondence and the amount of numbers selected by the player. For example, a player may be awarded a larger prize for selecting five numbers and matching all five numbers, than for selecting ten numbers and matching five of those numbers.

Bingo is another common lottery and casino game. In Bingo, each player selects one or more game card consisting of a five-by-five matrix of numbers from the range of 1 to 75. The first column contains five numbers selected from the range of 1 to 15, the second column contains five numbers selected from the range of 16 to 30, the third column typically contains four numbers selected from the range of 31 to 45 and a square entitled "FREE SPACE" in the center, the fourth column contains five numbers selected from the range of 46 to 60, and the fifth column contains five numbers selected from the range of 61 to 75. At the time of the drawing, numbers from the range of 1 to 75 are drawn randomly until at least one player matches a predetermined winning pattern, such as matching all the numbers in a row, column or diagonal, matching the four corners of the Bingo card, or matching any other pattern designated as a winning pattern. The player or players matching a winning pattern first are awarded a prize for the game. Larger prizes may also be awarded for matching particular patterns, or for matching the winning pattern within a predetermined number of drawn balls.

Pick-3 and Pick-4 games are somewhat similar to Powerball-style and Lotto games, wherein players select numbers or symbols from a predetermined range of numbers or symbols. In a Pick-3 game, players select a three-digit number (from 000 to 999) for their entry. At the time of making an entry, the player may be able to elect whether the three digit number must match the drawn three digit number exactly (straight bet) or whether the selected digits may appear in any order in the drawn three digit number (box bet). For example, if a player plays "123" in the Pick-3 as a straight bet, the player may only wins if the number "123" is drawn, while a player playing "123" as a box bet may win if "123," "132," "213," "231," "312" or "321" or "321" are drawn. In order to allow for the increased probability of winning a box bet, the player may either be required to wager a larger amount to box the bet, or be awarded a smaller prize amount due to the increased probability of having a winning entry. At the time of the drawing, three numbers are each drawn randomly from a separate set of numbers in the range of 0 to 9 such that digits may be repeated in the drawn three-digit number. In one implementation, three separate blower-type ball machines are used to conduct the drawing, with each machine containing ten balls each having a number between 0 and 9 printed thereon. The first-drawn ball is the first digit of the winning number, the second-drawn ball is the second digit of the winning number, and the third-drawn ball is the final digit. Pick-4 games are conducted in a similar manner using four digit numbers.

As previously mentioned, scratch-off lotteries do not involve a separate drawing conducted by the lottery. Instead, the lottery ticket includes indicia for conducting and determining the outcome of the scratch-off game, with the indicia being covered by a material that may be scratched off to expose the indicia disposed there under. For other games, such as pull tab games, the game indicia and/or the entire ticket may be covered by a covering sheet or substrate, with all or portions thereof being removable to expose the game indicia when the game is played by the player. The scratch-off or pull tab games may configured so that each ticket is predetermined to be a winning or losing entry for the game, or configured so that the each ticket may be either a winning or losing entry, with the outcome being determined based on the order or manner in which the player exposes the covered game indicia on the lottery ticket. In the former type of scratch-off or pull tab game, the indicia is configured to indicate whether the ticket is winning or losing entry, and the player merely removes the covering to expose the indicia and evaluates the indicia to determine whether the ticket is a winning or losing ticket. Any player purchasing the ticket will achieve the same outcome.

In the latter type of scratch-off or pull tab game, the player typically removes the covering from a subset of the indicia disposed on the lottery ticket, and the player wins if the player selected a predetermined winning subset of the indicia. For example, the indicia on the lottery ticket may represent different dollar amounts that may be awarded for winning numbers with three of the dollar amounts being the same, and the three remaining dollar amounts being different. To play the game, the player may select and remove the covering from three of the dollar amounts. If the player exposes the three matching dollar amounts, the player wins the corresponding prize amount. If the player exposes one or more of the non-matching dollar amounts, the player does not win a prize for that lottery ticket. Consequently, each ticket may potentially be a winning ticket, but the ticket will only be a winning ticket if the player selects and uncovers the winning combination of indicia.

Upon completion of the lottery game, the lottery tickets may be redeemed by the players and the winning entries may be determined at block 368. For the lottery games for which a drawing is conducted with the outcome of the drawing being compared to each of the player's entries to determine whether the entries are winning entries, the results of the drawing may be entered and recorded in the lottery system 100 at the lottery host computer 134, for example. In implementations where the player entries are stored in databases at the lottery host computer 134 and/or the lottery terminal units 104, the player entries for the occurrence of the lottery game may be compared to the outcome of the lottery drawing to determine which player entries are winning entries. Based on the results of the comparison, the lottery system 100 may generate a listing of winning entries for the occurrence of the lottery game When a player presents a lottery ticket at a sales agent location for redemption, the lottery ticket may be inserted in the ticket reader 132 of the lottery terminal unit 104. The lottery terminal unit 104 may use the information encoded on the lottery ticket to retrieve information from the lottery system 100 to determine whether the lottery ticket is a winning ticket. Alternatively, where the player's selections are encoded on the lottery ticket, the lottery terminal unit 104 or central host computer 134 may compare the player's selections to the drawing outcome to determine whether the lottery ticket is a winning ticket, and determine the corresponding award amount. Still further, the lottery ticket, and in particular a scratch-off and pull tab tickets or Bingo card, may be evaluated by a sales agent to determine whether the lottery ticket is a winning ticket, and any corresponding prize award.

Once the prize award for the lottery ticket is determined, the value may be dispensed to the player corresponding to the prize amount determined for a winning lottery ticket at block 370. The dispensed value may be in any appropriate form, including direct cash payments by the sales agent to the players, printing and issuance of a credit voucher or check at the lottery terminal unit 104, applying credit to a debit card, credit card, smart card, player's lottery or bank account, or any other mechanism for dispensing value to the player.

Figure 6:
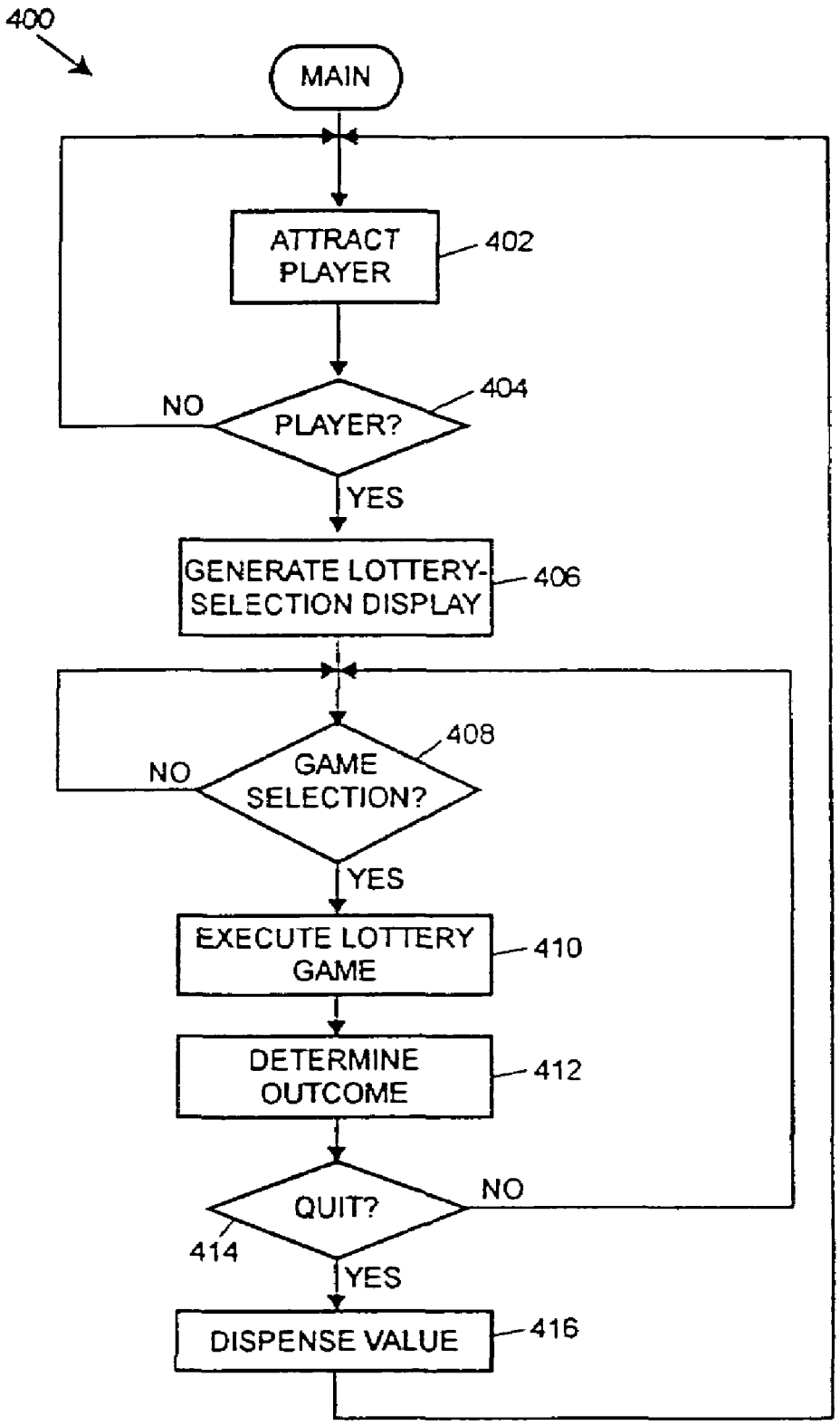
FIG. 6 is a flowchart of an embodiment of a lottery routine including an instant win game.

FIG. 6 is a flowchart of an alternative embodiment of an automated main operating routine 400 that may be stored in the memory 202 of the controller 200 of the lottery terminal unit 104 that may be adapted to allow the player to play interactive lottery games, such as video poker, video Keno, video blackjack, video Bingo and the like. The main routine 400 may begin operation at block 402 during which an attraction sequence may be performed in an attempt to induce a potential player to play the lottery terminal unit 104, 116. The attraction sequence 402 may be performed by displaying one or more video images on the display 128 and/or causing one or more sound segments, such as voice or music, to be generated via the speakers 216. The attraction sequence 402 may include a scrolling list of video lottery games that may be played on the lottery terminal unit 104, 116 and/or images of various lottery games being played, such as video poker, video Keno, video blackjack and the like.

During performance of the attraction sequence, if a potential player makes any input to the gaming unit 104 as determined at block 404, the attraction sequence may be terminated and a game-selection display may be generated on the display 128 at block 406 to allow the player to select a lottery available on the lottery terminal unit 104. The lottery terminal unit 104 may detect an input at block 404 in various ways. For example, the lottery terminal unit 104 could detect if the player presses any button on the control panel 124, could determine whether the player deposited currency into a coin slot or currency reader, inserted a smart card into the card reader 130, or recognized any other input of value by the player.

The game-selection display generated at block 406 may include, for example, a list of video lottery games that may be played on the lottery terminal unit 104 and/or a visual message to prompt the player to deposit value into the lottery terminal unit 104. While the game-selection display is generated, the lottery terminal unit 104 may wait for the player to make a game selection. At block 408, if no game selection is made within a given period, the operation may branch back to block 402. Upon selection of one of the games by the player as determined at block 408, the controller 200 may execute one of a number of lottery game routines at block 410 to allow player to play the selected lottery game. The lottery game routine executes and allows the player to play the selected lottery game. For example, when playing video poker, the player may be allowed to indicate whether to hold or drop cards dealt by the lottery terminal unit 104 to the player. In video Keno, the player may select up to ten or fifteen numbers from 1 to 80 to use as the player's game entry. In video blackjack, the player may indicate whether to hit or stand on a hand, or split or double down on a hand. At the end of the game, the outcome may be determined at block 412. The lottery terminal unit 104 may determine the amount of any prize won by the player and corresponding to the player's wager on the game, and increment the amount of credits for the player on the lottery terminal unit 104.

At this point, the player may elect to quit the game and cash out the player's credits at block 414. If the player wishes to stop playing the lottery terminal unit 104 and "Cash Out" any accumulated credits, the controller 200 may dispense value to the player at block 416 based on the outcome of the game(s) played by the player. The operation may then return to block 402. If the player does not wish to quit as determined at block 414, the routine may return to block 406 where the game-selection display may again be generated to allow the player to select another game.

Large Progressive/Non-Progressive Lottery Jackpot Payout

As previously discussed, in progressive lotteries, progressive jackpots are awarded to players matching all the numbers drawn from a predetermined range or ranges, and players matching some but fewer than all the drawn numbers, such as matching five, four and three numbers, may be awarded payout amounts based on a predetermined paytable. If no players match all the drawn numbers, the progressive jackpot may roll over to the next drawing, and the progressive jackpot may grow to tens or hundreds of million dollars. In large non-progressive lotteries, such as Cash Lotto-type games, the jackpot may be award to players matching all the drawn numbers or, if no player matches all the drawn numbers, revert to the lottery sponsor, and players matching some but fewer than all the drawn numbers, such as matching five, four and three numbers, may be awarded payout amounts based on a predetermined paytable. As an alternative, methods are contemplated for distributing large progressive and/or non-progressive lottery jackpots among groups of otherwise non-winning players, or players winning small prizes for the lottery games.

Figure 7:
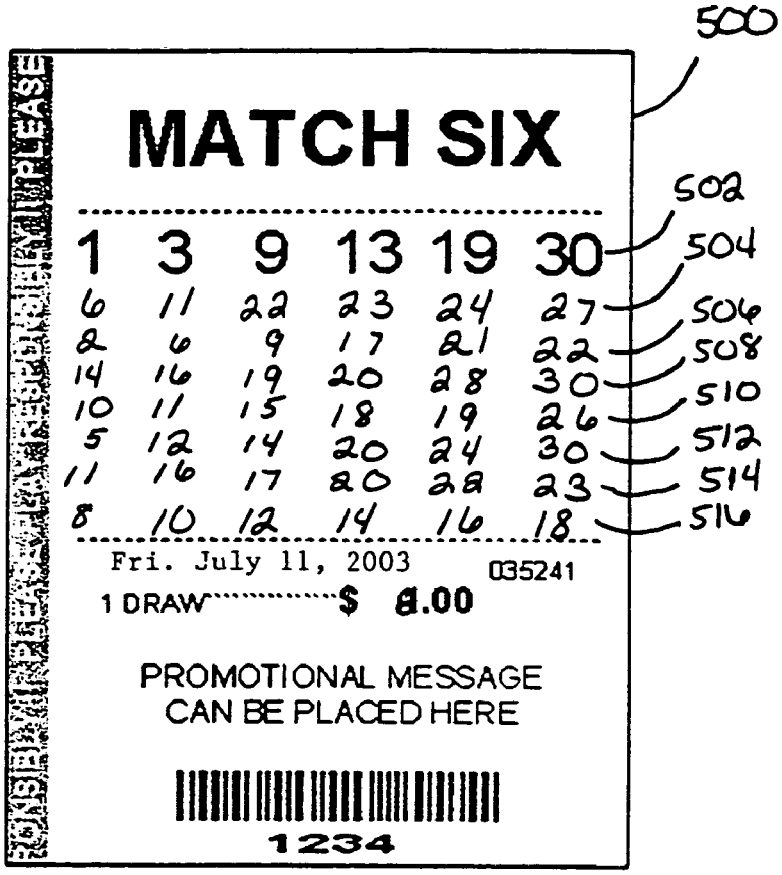
FIG. 7 illustrates an embodiment of a lottery ticket that may be generated for a large progressive or non-progressive lottery game that may be generated by the lottery terminal unit of FIG. 2.

In one embodiment, the large progressive or non-progressive lottery jackpots may be distributed equally to all lottery entries wherein each of the numbers in the player's entry varies from the drawn numbers by the same amount. FIG. 7 illustrates a sample lottery ticket 500 for a progressive lottery game in which players attempt to match six drawn numbers. For the given occurrence of the lottery game, the player may have made eight entries 502–516 at a lottery terminal unit 104 via manual selections or as quick pick selections generated by the lottery terminal unit 104. When the lottery game is executed at block 366, and winning entries are determined at the block 368 of FIG. 5, each of the players' entries for the lottery game may be compared to the drawn six numbers to determine whether all six entries of any entry matches the six drawn numbers. If none of the entries for the drawing match all six numbers, the lottery system may be configured to distribute the jackpot between all or subset of the entries failing to match any of the drawn numbers and, consequently, under current pay tables may result in no awards to the players. In this way, additional awards may be paid to previously non-winning players instead of including players that may match, for example, five, four or three numbers and already be provided with an award, thereby potentially increasing the number of players winning prizes for the lottery drawing.

Figure 9:
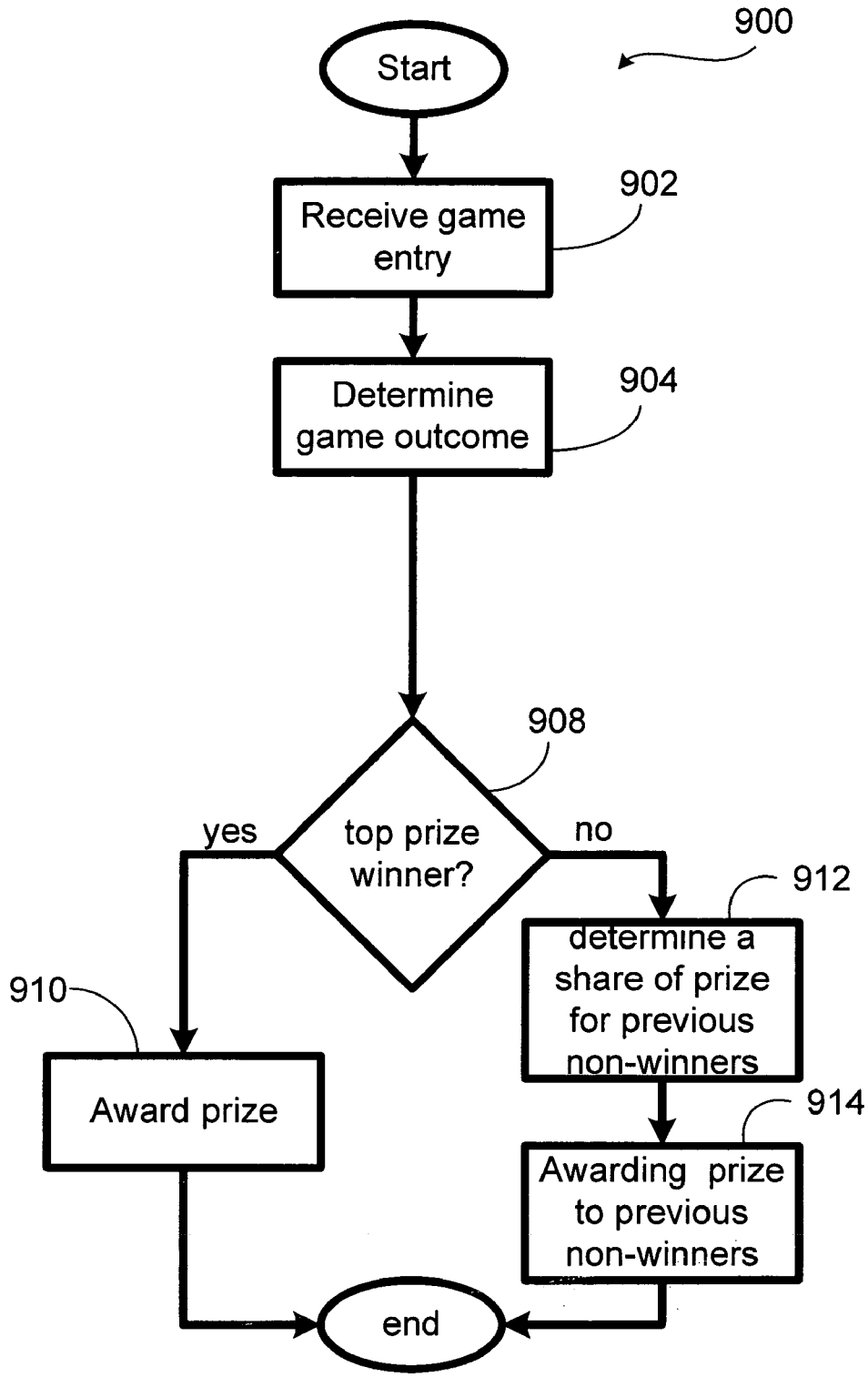
FIG. 9 illustrates a flowchart for an alternative embodiment of a lottery routine.

FIG. 9 depicts the process discussed above. After a player decided to play a lottery game, the player may enter game specific selections, such as game indicia, and such selections will be received by the lottery system, step 902. The lottery system executes the lottery game and determines an outcome for the lottery game, step 904. After the outcome of the lottery game is determined, the lottery system can check whether there is any jackpot (top prize) winner, step 908. If there are some jackpot winners, then the prize is awarded to the jackpot winners, step 910. If there are no jackpot winners for the top prize, the lottery system can determine a share of the jackpot to be distributed to players who are previously non-winners of the lottery game, step 912, and award the prize to these players, step 914.

In one embodiment, the progressive jackpot may be divided equally between each of the entries failing to match any of the drawn numbers. In another embodiment, the progressive jackpot may be divided equally between a subset of the entries failing to match any of the drawn numbers, with the subset being determined based on other criteria. For example, the progressive jackpot may be split between players having tickets with five or more entries failing to match any of the drawn numbers. As another example, the subset may consist of all the entries failing to match any of the drawn numbers, and for which each of the numbers of the entry differs corresponding drawn numbers by same number. The entries for all the players may be stored at the host computer 134, and the host computer 134 may be configured to compare each entry to the drawn numbers. If the host computer 134 determines that none of the entries matches all six drawn numbers, the host computer 134 may be configured to determine the difference between each number of an entry and a corresponding one of the drawn numbers. Each entry for which the difference between each of the numbers of the entry and the corresponding one of the drawn numbers may be awarded a share of the jackpot. The difference may be required to be the same amount in either the positive direction or the negative direction for all the numbers, or may only be required that the absolute value of the difference be the same amount.

For example, the drawn numbers for the lottery drawing may be 2-4-10-14-20-31, with the player's entries 502–516 as shown in FIG. 7. The host computer 134 may compare the drawn numbers to the entry numbers by determining the difference between the lost number of the drawn numbers and the entry numbers, between the next lowest number of the drawn numbers and the entry numbers, and so on. If the difference between each of the corresponding numbers is the same, the host computer 134 may declare the entry a winner of a share of the jackpot. Thus, for entry 502 on ticket 500 having numbers 1-3-9-13-19-30, each number of the entry 502 differs from the corresponding drawn number by one. Consequently, the host computer 134 may declare entry 502 a winner of a share of the jackpot and, when the ticket 500 is redeemed at a lottery terminal unit 104 at block 368 of routine 350, the player may be paid an award equal to a share of the jackpot. The following entries may also be declared winning entries where numbers are drawn, for example, from the range of 1 to 36: 3-5-11-15-21-32 (difference of 1), 4-6-12-16-22-33 (difference of 2), 5-7-13-17-23-34 (difference of 3), 6-8-14-18-24-35 (difference of 4), and 7-9-15-19-25-36 (difference of 5). Where only the absolute magnitude of the difference must be the same, 2-5-9-15-21-32 (difference of plus or minus 1) may also be a winning entry.

It may be desired to provide additional opportunities for players to share in the jackpot. Because the numbers may be selected from a finite range of numbers such as 1 to 36, the host computer 134 may be configured to determine whether entry and drawn numbers differ by the same number when the numbers "wrap around" the beginning or the end of the range. For example, entry 512 on ticket 500 contains numbers, 5-12-14-20-24-30. If the entry is compared to the drawing in the manner discussed above, the differences between the entry numbers and the corresponding drawn numbers 2-4-10-14-20-31 would be 3-8-4-6-4-1. However, the numbers may be further evaluated to determine whether, if a number were wrapped around the range to the beginning of the range, the difference between highest number of the entry or drawn numbers would differ from the lowest number of the other group by the same amount as the other numbers. Using the present example, 31 would differ from 5 by ten because 31 is five from the end of the range and five to get to 5 for a total of ten. The remaining numbers are adjusted accordingly such that lowest drawn number 2 may be compared to the second lowest entry number 12, the second lowest drawn number 4 may be compared to the third lowest entry number 14, and so on with each differing by ten and, thereby, may result in a winning entry. The evaluation may be performed in either direction, and may be performed comparing each of the entry numbers to each of the draw numbers.

The above method for dividing the jackpot between non-winning entries may be applied in large progressive and non-progressive lotteries. Moreover, the method may be applied in each drawing for which no entries match all the drawn numbers, such as for large non-progressive jackpots, or applied to drawings after a progressive jackpot exceeds a maximum jackpot payout amount. For example, a state lottery may routinely generate progressive jackpots over $100,000,000. The present method may be applied after the progressive jackpot exceeds a maximum jackpot payout of $50,000,000. Once the maximum is reached, the method may be applied to divide the progressive jackpot as discussed above. Alternatively, the portion of the progressive jackpot in excess of the maximum jackpot payout amount may be divided as discussed above, with the maximum jackpot amount continuing to carry over to subsequent drawings until an entry matches all the drawn numbers.

In another alternative embodiment for dividing large progressive and non-progressive jackpots, a subset of the entries do not match any of the drawn numbers may be determined by drawing additional numbers that must be avoided by the non-matching entries in order to share in the divided jackpot or portion thereof. For example, once the host computer 134 determines that no entries match all of the drawn numbers, six additional numbers may be drawn from the same range of numbers and compared to the non-matching entries by the host computer 134. Any entry not matching any of the twelve numbers selected between the primary draw and the subsequent draw may be awarded a share of the jackpot. Of course, as discussed above, the entire jackpot may be divided, or only a portion of the jackpot above a predetermined maximum jackpot payout amount.

Figure 8:
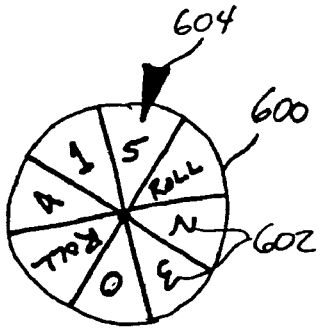
FIG. 8 illustrates an alternative embodiment of a wheel that may be used to select a group for distribution of a lottery jackpot for a large progressive or non-progressive lottery game that may be generated by the lottery terminal unit of FIG. 2.

In a further embodiment, each of the players of a drawing may have an opportunity to receive a share of the jackpot when the progressive jackpot exceeds a predetermined maximum payout amount without an entry matching all of the drawn numbers. In this embodiment, the distribution of the progressive jackpot may be based on the random selection of a group of entries each that may have matched the same number of drawn numbers. In the event that no one has matched all the drawn numbers to win the progressive jackpot, a random selection may be made, either manually or electronically by, for example, the host computer 134, of one of the number of matched or unmatched numbers or, if desired, to roll over the jackpot. For example, FIG. 8 illustrates a wheel 600 having indicia 602 that may correspond to each potential award group or to roll over the jackpot. The wheel 600 may further include a pointer 604 indicating which of the indicia 602 identifies the award group. The wheel 600 may be implemented mechanically or electronically as a display of the outcome of the random selection of an award group performed by, for example, the host computer 134.

Another methodology is to award all losing players with a proportionate share of the jackpot. Still another example is to award all losing players that have matched at least two numbers. Another possibility is to award players based on the number of entries that they had in the game. For example, only players that have five or more losing entries on a lottery ticket may be eligible to win an award.

Whatever the award basis, it should be verifiable with the information printed on the ticket when read by the lottery terminal to easily process the payout transaction. In addition, none of the methodologies discussed above necessarily exclude considering players that have won some award in the game as being members of the losing player group. Therefore, it is also possible to formulate a losing player group that also includes players that have won some award in the game.

In addition to dividing large progressive and non-progressive jackpots among non-winning players, the structure for paying out large jackpots may be modified to split the jackpot into two or more progressive jackpots and roll over a portion of the jackpot money to subsequent drawings. A method for funding a progressive lottery game may include multiple progressive jackpots and a percentage multiplier that is applied to at least one of the jackpots. Through the use of multiple progressive jackpots and the percentage multiplier as discussed herein, lottery sponsors may be able to achieve a more consistent and higher average jackpot level than can be maintained under the standard progressive jackpot payout structure. As a result, the players may be offered the potential for winning a significantly larger average sized jackpot more often than a standard progressive lottery.

In one embodiment, two progressive jackpots are generated from the money wagered by the players on the lottery game: a base jackpot and a bonus jackpot. A portion of each player's wager may be used to find the progressive jackpots, with a predetermined percentage of each player's wager being added to the base jackpot and a predetermined percentage being added to the bonus jackpot. Players matching all the drawn numbers for a lottery drawing may be entitled to receive all or a share of the entire base jackpot, and an opportunity to win all or a portion of the bonus jackpot. The amount of the bonus jackpot awarded to the players matching all the numbers for a drawing may be determined by randomly selecting a payout percentage multiplier to be applied to the bonus jackpot. The randomly selected multiplier may be determined either before, during or after the drawing to which the multiplier may be applicable and, if determined prior to the drawing, the randomly selected multiplier may be printed on each players' lottery ticket at the time of purchase.

In a typical state progressive lottery, the winning lottery numbers typically may be drawn from a set of numbered balls. In one embodiment, the multiplier value to be applied to the bonus jackpot may be determined in a similar way via a separate set of marked balls from which one ball may be drawn randomly to determine the multiplier value to be applied to the bonus jackpot. Alternatively, a mechanical or electro-mechanical rotating wheel and pointer, which may be similar to the wheel 600 described above with indicia 602 corresponding to payout percentages, may be used as a random number generator for determining the percentage of the bonus pool to be awarded to the jackpot winning players. The wheel may be spun and may randomly or quasi-randomly select a multiplier value. The wheel may be electronic or electro-mechanical. Still further, the multiplier value may be randomly determined electronically, such as by being generated at the host computer 134. Regardless of the method by which the multiplier value may be determined, a quasi-random selection can be utilized to pay out the progressive jackpots of desired sizes at predetermined payout rates.

While the multiplier value for the bonus jackpot may be, among other values, 100%, it may be more probable that a player may only win a fraction of the accumulated bonus jackpot. Where the multiplier value may be less than 100%, the remainder of the bonus jackpot may be carried over to the next lottery drawing. The subsequent progressive jackpots may therefore potentially have relatively high initial bonus jackpot pools that may be attractive to the lottery players. Consequently, even a fraction of the generally sizeable bonus jackpot in addition to the base jackpot may produce a substantial and significant award for the players.

In an alternative embodiment applicable to large non-progressive jackpots, the bonus jackpot may be maintained at some constant value regardless of the number of bonus jackpot rollovers that occur. Still further, the multiple jackpot strategy may be applied to multiple prize levels for a single lottery game. For example, in Lotto games where entries may consist of six numbers selected from a predetermined range of numbers, and the drawing may consist of drawing six numbers from the predetermined range of numbers and comparing the drawn numbers to the numbers of the entries, a progressive jackpot may be awarded to entries matching all six drawn numbers, and fixed prize amounts may be awarded for entries matching some but fewer than all six numbers, such as three, four or five numbers. One of the prize levels, such as the prize for matching five out of six drawn numbers, may be paid off with a progressive jackpot instead of a fixed prize amount. For example, a first progressive jackpot for matching all six numbers may be determined based on a $10,000,000 base amount plus thirty percent of the money wagered on the Lotto game, and a second progressive jackpot for matching five out of six numbers may be determined based on a $100,000 base amount plus ten percent of the money wagered on the Lotto game. The first and second progressive jackpots may each be divided into a base jackpot and a bonus jackpot, with the payouts from the bonus jackpots being paid out based on a randomly determined percentage as described above. If desired, either the same randomly determined percentage or a different randomly determined percentage may be applied to each progressive jackpot for the lottery game. Those skilled in the art will understand that multiple jackpots as described herein may be applied to any type of lottery game, may divide a single jackpot into any desired number of levels, and may be applied to any number of jackpots offered in a given lottery game.

The large progressive and non-progressive jackpots may be divided into more than the two jackpots discussed above. For example, the large progressive or non-progressive jackpot may be divided into a base jackpot, a bonus jackpot and a further super jackpot that may be funded by the players' wagers. The bonus jackpot and the super jackpot may both be awarded in the same manner as described above using randomly selected multiplier values. If desired, separate multiplier values may be determined, with one being applied to the base jackpot and the other being applied to the super jackpot.

What is claimed is:

1. A method for awarding at least a portion of a jackpot amount in a lottery game for a plurality of players, comprising:

accepting an entry from each of the plurality of players for an occasion of the lottery game, each entry comprising a first subset of numbers selected from a predetermined range of numbers;

determining an outcome for the occurrence of the lottery game, the outcome for the occurrence of the lottery game comprising a second subset of numbers selected from the predetermined range of numbers;

comparing the first subset of numbers for each of the entries to the second subset of numbers for the outcome of the lottery game;

determining the number of matched numbers for each entry between the first subset of numbers for the entry and the second subset of numbers for the outcome of the lottery game based on the comparison of the first subset of numbers for each entry of the second subset of numbers for the outcome of the lottery game;

determining that none of the entries for the occurrence of the lottery game match every number in the first subset of numbers for the entry to a corresponding one of the numbers in the second subset of numbers for the outcome of the lottery game;

awarding a share of the at least a portion of the jackpot amount to at least a portion of the entries for the occurrence of the lottery game wherein none of the numbers of the first subset of numbers of the entry match any of the numbers in the second subset of numbers for the outcome of the lottery game;

determining the difference between each number of the first subset of numbers and a corresponding one of the numbers of the second subset of numbers for the outcome of the lottery game for each entry wherein none of the numbers of the first subset of numbers of the entry match any of the numbers in the second subset of numbers for the outcome of the lottery game; and awarding a share of the at least a portion of the jackpot amount to each of the entries for the occurrence of the lottery game wherein none of the numbers of the first subset of numbers of the entry match any of the numbers in the second subset of numbers for the outcome of the lottery game and the difference between each number of the first subset of numbers of the entry and the corresponding one of numbers of the second subset of numbers for the outcome of the lottery game is equal.

2. A method for awarding at least a portion of a jackpot amount in a lottery game for a plurality of players, comprising:

accepting an entry from each of the plurality of players for an occasion of the lottery game, each entry comprising a first subset of numbers selected from a predetermined range of numbers;

determining an outcome for the occurrence of the lottery game, the outcome for the occurrence of the lottery game comprising a second subset of numbers selected from the predetermined range of numbers;

comparing the first subset of numbers for each of the entries to the second subset of numbers for the outcome of the lottery game;

determining the number of matched numbers for each entry between the first subset of numbers for the entry and the second subset of numbers for the outcome of the lottery game based on the comparison of the first subset of numbers for each entry of the second subset of numbers for the outcome of the lottery game;

determining that none of the entries for the occurrence of the lottery game match every number in the first subset of numbers for the entry to a corresponding one of the numbers in the second subset of numbers for the outcome of the lottery game;

awarding a share of the at least a portion of the jackpot amount to at least a portion of the entries for the occurrence of the lottery game wherein none of the numbers of the first subset of numbers of the entry match any of the numbers in the second subset of numbers for the outcome of the lottery game;

selecting a third subset of numbers from the predetermined range of numbers;

comparing the first subset of numbers to the third subsets of numbers for each of the entries wherein none of the numbers of the first subset of numbers of the entry match any of the numbers in the second subset of numbers for the outcome of the lottery game; and awarding a share of the at least a portion of the jackpot amount to each of the entries for the occurrence of the lottery game wherein none of the numbers of the first subset of numbers of the entry match any of the numbers in the second subset of numbers for the outcome of the lottery game and none of the numbers of the first subset of numbers of the entry match any of the numbers in the third subset of numbers for the outcome of the lottery game.

3. A method for awarding at least a portion of a jackpot amount according to claim 2, wherein none of the numbers in the third subset of numbers are also in the second subset of numbers for the outcome of the lottery game.

4. A method for awarding at least a portion of a jackpot amount in a lottery game for a plurality of players, comprising:

accepting an entry from each of the plurality of players for an occasion of the lottery game, each entry comprising a first subset of numbers selected from a predetermined range of numbers;

determining an outcome for the occurrence of the lottery game, the outcome for the occurrence of the lottery game comprising a second subset of numbers selected from the predetermined range of numbers;

comparing the first subset of numbers for each of the entries to the second subset of numbers for the outcome of the lottery game;

determining the number of matched numbers for each entry between the first subset of numbers for the entry and the second subset of numbers for the outcome of the lottery game based on the comparison of the first subset of numbers for each entry of the second subset of numbers for the outcome of the lottery game;

determining that none of the entries for the occurrence of the lottery game match every number in the first subset of numbers for the entry to a corresponding one of the numbers in the second subset of numbers for the outcome of the lottery game;

awarding a share of the at least a portion of the jackpot amount to at least a portion of the entries for the occurrence of the lottery game wherein none of the numbers of the first subset of numbers of the entry match any of the numbers in the second subset of numbers for the outcome of the Lottery game;

determining that the jackpot amount is greater than a predetermined maximum jackpot payout amount; and awarding shares of the at least a portion of the jackpot amount to entries matching fewer than all of the numbers of the first subset of numbers to numbers of the second subset of numbers for the outcome of the occurrence of the lottery game where the jackpot amount is determined to be greater than the predetermined maximum jackpot payout amount.

5. A method for awarding at least a portion of a jackpot amount according to claim 4, comprising awarding a share of the portion of the jackpot amount greater than the predetermined maximum jackpot amount to at least a portion of the entries for the occurrence of the lottery game wherein none of the numbers of the first subset of numbers of the entry match any of the numbers in the second subset of numbers for the outcome of the lottery game.

* * * * *